United States Patent [19]

Nenstiel et al.

[11] Patent Number: 5,050,669

[45] Date of Patent: Sep. 24, 1991

[54] TUBE SUPPORT

[75] Inventors: Kurt F. Nenstiel; Mark A. Adams, both of York, Pa.

[73] Assignee: York International Corporation, York, Pa.

[21] Appl. No.: 588,546

[22] Filed: Sep. 26, 1990

[51] Int. Cl.[5] ..... F28F 9/00

[52] U.S. Cl. ..... 165/162; 122/510

[58] Field of Search ..... 165/158, 162; 122/510

[56] References Cited

U.S. PATENT DOCUMENTS

| | | | |
|---|---|---|---|
| 1,382,509 | 6/1921 | Hooyman . | |
| 1,430,769 | 10/1922 | Thompson | 165/162 |
| 1,748,140 | 2/1930 | Muhleisen . | |
| 1,802,413 | 4/1931 | Engler | 165/162 X |
| 1,834,404 | 12/1931 | Koch . | |
| 2,236,882 | 4/1941 | Vorkauf . | |
| 2,345,257 | 3/1944 | Hensel et al. . | |
| 2,353,443 | 7/1944 | Carpenter et al. . | |
| 2,396,241 | 3/1946 | Besler et al. . | |
| 2,830,799 | 4/1958 | Amerio | 165/162 |
| 2,876,975 | 3/1959 | Short . | |
| 3,442,763 | 5/1969 | Chetter et al. | 165/162 X |
| 3,708,142 | 1/1973 | Small . | |
| 3,854,529 | 12/1974 | Sagan . | |
| 3,937,277 | 2/1976 | Krolmann et al. . | |
| 3,967,677 | 7/1976 | Mohlman . | |
| 4,013,024 | 3/1977 | Kochey, Jr. et al. . | |
| 4,127,165 | 11/1978 | Small . | |
| 4,131,270 | 12/1978 | Williams et al. | 269/321 W |
| 4,136,736 | 1/1979 | Small . | |
| 4,183,484 | 1/1980 | Mathews . | |
| 4,194,671 | 3/1980 | Williams et al. | 228/183 |
| 4,210,202 | 7/1980 | Boyer et al. | 165/162 |
| 4,276,930 | 7/1981 | Weber . | |
| 4,344,480 | 8/1982 | Boyer et al. | 165/162 |
| 4,386,456 | 6/1983 | Volz . | |
| 4,433,721 | 2/1984 | Biaggi . | |
| 4,450,904 | 5/1984 | Volz . | |
| 4,480,594 | 11/1984 | Sullivan et al. . | |
| 4,553,588 | 11/1985 | Geissler . | |
| 4,579,304 | 4/1986 | Williams | 248/68.1 |
| 4,595,161 | 6/1986 | Williams | 248/68.1 |
| 4,648,442 | 3/1987 | Williams | 165/162 |
| 4,665,866 | 5/1987 | Wepfer . | |
| 4,702,311 | 10/1987 | Bizard . | |
| 4,796,695 | 1/1989 | Cannon . | |
| 4,823,866 | 4/1989 | Hunt . | |

FOREIGN PATENT DOCUMENTS

| | | | |
|---|---|---|---|
| 731266 | 4/1980 | U.S.S.R. | 165/162 |

*Primary Examiner*—Allen J. Flanigan

*Attorney, Agent, or Firm*—Finnegan, Henderson, Farabow, Garrett & Dunner

[57] ABSTRACT

A tube support includes at least two parallel plates. With more than two plates, the outer plates are longer in the direction of flow than the inner plates. Pins are provided proximate the leading and trailing edges of the plates in order to maintain the plates in a spaced relationship. The pins proximate each edge are positioned slightly over two tube diameters from the other pins along the same edge. Additionally, the pins along the trailing edge are positioned approximately one tube diameter from the pins proximate the leading edge in a direction along the edge in order to stagger the leading and trailing pins.

8 Claims, 4 Drawing Sheets

TUBE SUPPORT

BACKGROUND OF THE INVENTION

1. Field of the Invention

The present invention relates to a tube support for use in a heat exchanger.

2. Description of the Related Art

Frequently, in a heat exchanger, fluid will be made to flow within a conduit along the exterior of heat exchanging tubes. The tubes must be held in place by tube supports fitted within the conduit. Two important factors influence the suitability of the tube support: it should be non-blocking of the fluid and it should allow for easy installation of the tubes despite manufacturing tolerances.

Conventional tube supports are deficient in both areas. Those tube supports are typically fashioned from parallel plates which are held together by orthogonal retaining members passing through the plates. Typically, those retaining members are located in the same plane approximately one tube diameter apart. Examples of such conventional tube supports are shown in U.S. Pat. No. 4,480,594 to Sullivan et al. and U.S. Pat. No. 4,013,024 to Kochev, Jr. et al.

The orthogonal retaining members in a conventional tube support limit the available cross section through which the heat exchanging fluid may flow. Additionally, they tend to create a high velocity which results in a large pressure drop as the fluid passes through the blocking area. This pressure drop is critical because the heat exchange fluid is often near the saturation point, and the pressure drop will cause the fluid to produce gas bubbles (i.e., flashing). Flashing further blocks the fluid flow.

Additionally, the retaining members in conventional tube supports make it difficult to insert the tubes. Since the retaining members are relatively close together, it is critical that the tube supports be closely aligned so that tubes may be installed easily. Any warping of a support makes installation difficult.

SUMMARY OF THE INVENTION

An object of the invention is to provide a tube support with reduced fluid blocking. It is a further object to provide a tube support which allows easy tube installation.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a tube support for use in a heat exchanger wherein a heat transfer medium flows outside and parallel to the tubes, the tube support comprising at least three parallel plates, and means for retaining the plates in a spaced parallel relationship, the parallel plates and the retaining means being arranged so as to provide minimal flow blockage at any cross-section by gradually increasing and decreasing the blocking cross-section in the direction of fluid flow in a plurality of separate steps which are at different flow cross-sectional positions.

To achieve the objects and in accordance with the purpose of the invention, as embodied and broadly described herein, the invention further comprises a support for tubes, the support for use in a heat exchanger wherein a heat transfer medium flows outside and parallel to a plurality of tubes, the tube support comprising multiple parallel plates; and means for retaining the plates in a spaced parallel relationship, the means being arranged to allow the movement of the tubes in a direction orthogonal to their axes and parallel to the plates.

Preferably, the retaining means comprises multiple plate retaining members oriented orthogonally to the plate surfaces wherein the plate retaining members are proximate the leading and trailing edges of the plates, and the retaining members proximate the trailing edge are spaced, in a direction orthogonal to the axis of the tubes and parallel to the plates, from the retaining members proximate the leading edge.

It is to be understood that both the foregoing general description and the following detailed description are exemplary and explanatory only and are not restrictive of the invention as claimed.

The accompanying drawings, which are incorporated in and constitute part of the specification, illustrate one embodiment of the invention and together with the description, serve to explain the principles of the invention.

DESCRIPTION OF THE PREFERRED EMBODIMENT

Reference will now be made in detail to the presently preferred embodiment of the invention, an example of which is illustrated in the accompanying drawings. Wherever possible, the same reference numbers will be used throughout the drawings to refer to the same or like parts.

Figure 1:
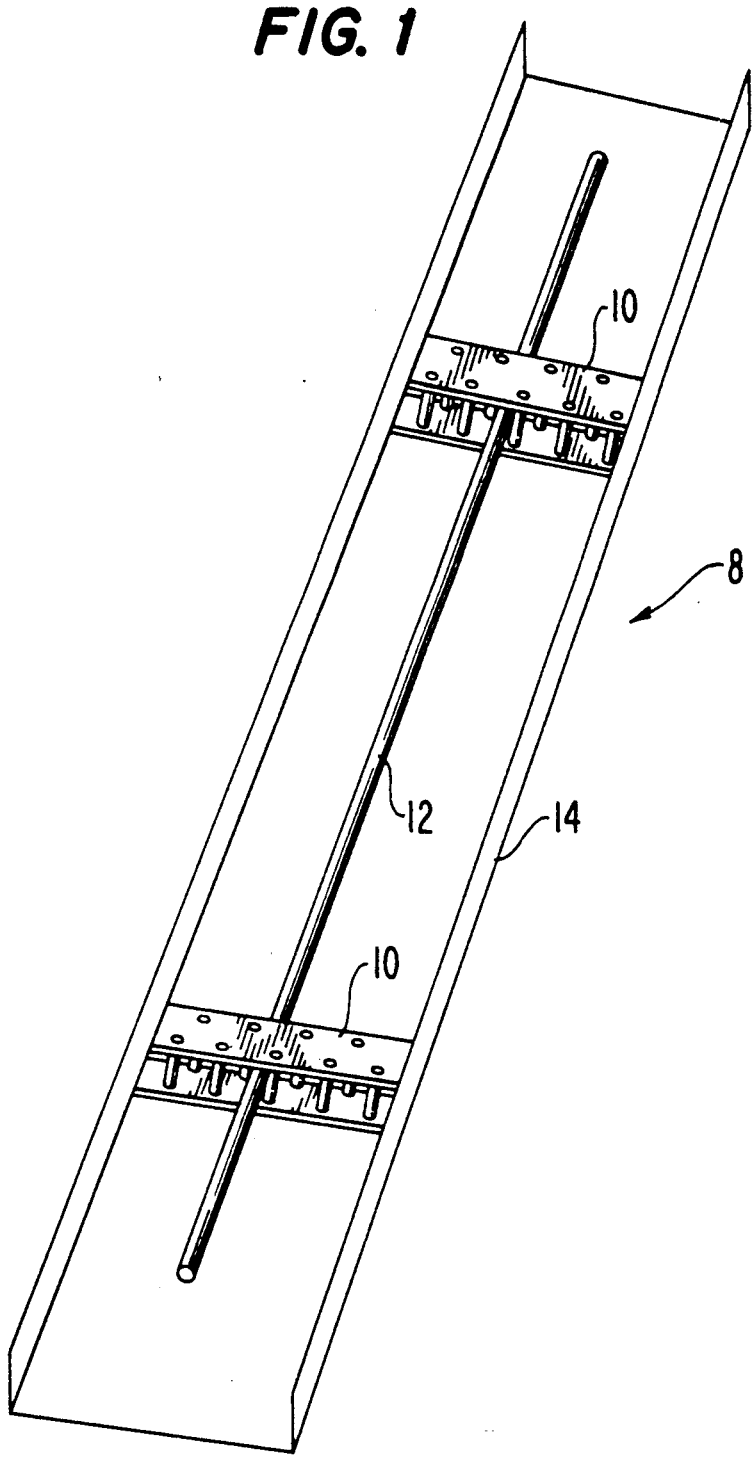
FIG. 1 is a perspective view of a partially assembled heat exchanger in which the heat exchanger tubes are supported by supports according to the invention.

As shown in FIG. 1, the invention comprises support 10 for supporting tubes 12 for use in heat exchanger 8. In a heat exchanger using the invention, a heat exchanging fluid flows within conduit 14 over the outside of tubes 12 and through supports 10. As shown, a plurality of tube supports 10 are used to support the tube within the heat exchanger conduit 14. As is understood in the art, the number of supports needed depends upon the length of the conduit and the size of the tubes. Similarly, the height and width of the tube support can be varied to meet the sizes of the conduit and tubes of the heat exchanger. Supports according to the invention could be used in subcoolers of screw and centrifugal water chillers, and other heat exchangers as understood in the art. Copper, copper/nickel alloy or other known suitable material may be used for the tubes.

Figure 2:
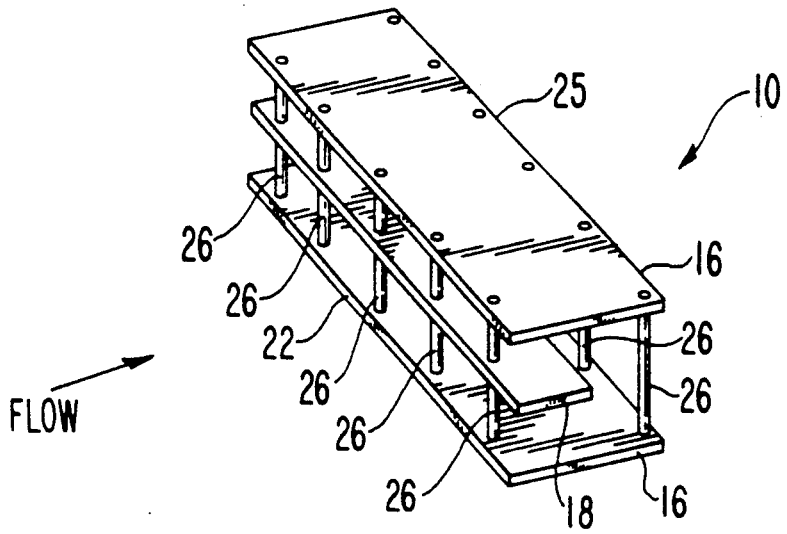
FIG. 2 is a perspective view of a support according to the invention.
Figure 3A:
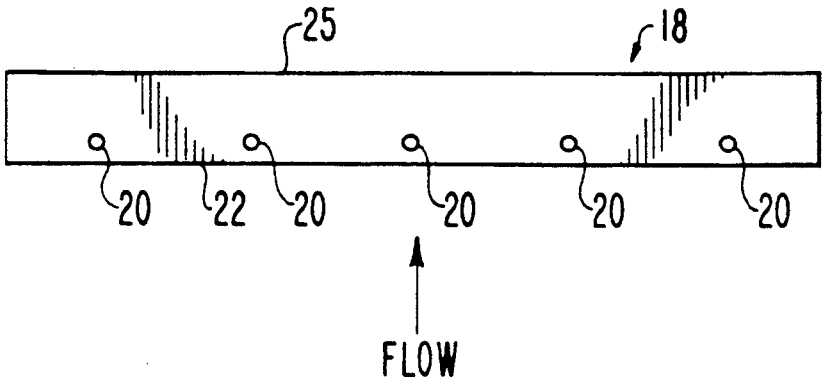
FIG. 3(*a*) and (*b*) depict an inner and outer plate, respectively, of a support according to the invention.
Figure 3B:
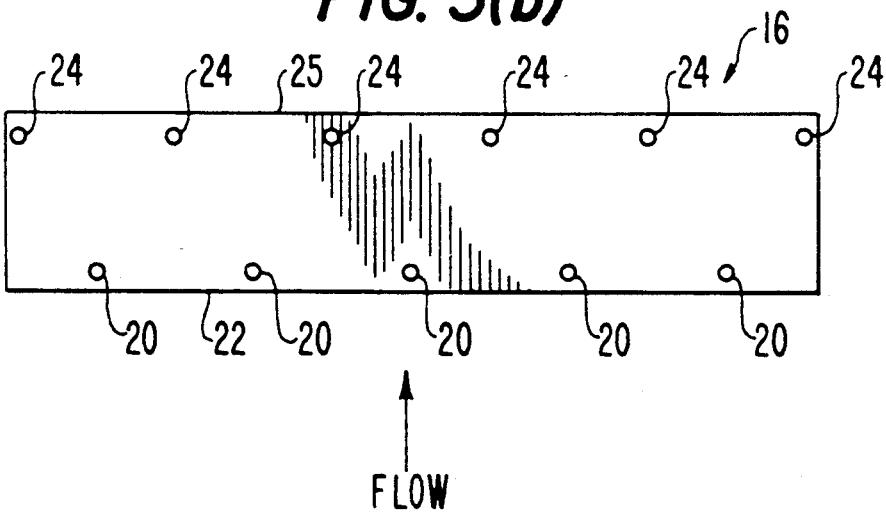
Figure 4A:
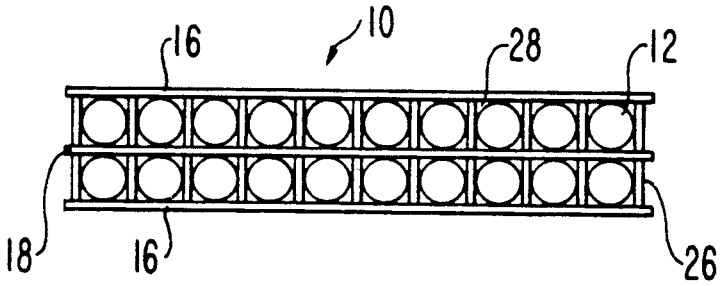
FIG. 4(*a*) and (*b*) are front and side views, respectively, of a support holding tubes according to the invention.
Figure 4B:
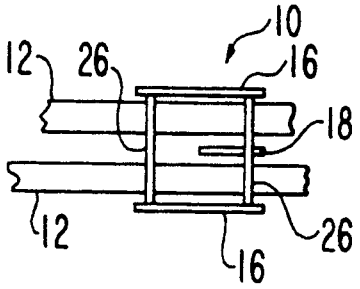

In accordance with the invention and as shown in FIG. 2, each support 10 comprises multiple parallel plates. Preferably, the two outer plates 16 are longer in the direction of flow than inner plates 18, as shown in FIG. 3. This configuration provides a gradual reduction of blocking cross-section. Preferably, plates 16 are twice as long as plates 18. The number of inner plates may vary depending on the desired number of tubes and tube layers to be supported. For example, FIG. 4 shows a three plate support which holds twenty tubes. Each additional inner plate would add capacity for ten additional tubes. Both plates 16 and 18 have drill holes 20 along leading edge 22. However, only the outer plates 16 have drill holes 24 along trailing edge 25. Holes 20 and 24 are arranged as will be discussed below. The plates are preferably made of cold rolled steel although they made be made from other materials as known in the art.

In accordance with the invention and as shown in FIG. 2, support 10 comprises retaining members 26 orthogonal to the surface of plates 16 and 18. Retaining members 26 support plates 16 and 18 in a spaced parallel relationship. The retaining members are preferably pins which are placed in holes 20 and 24. Preferably, the pins are secured to the plates by welding. Also, the pins are preferably made of cold rolled steel; a they made be made from other materials as known in the art.

Retaining members 26 are arranged so as not to block the flow of fluid through supports 10 and also arranged so as allow tubes 12 to be easily inserted into support 10. Holes 22 and retaining members 26 proximate leading edge 22 of the plates are positioned so that the opposed inner surfaces of the retaining member 26 are spaced slightly over two tube diameters from each other, and holes 24 and retaining members 26 along trailing edge 25 are similarly positioned so that there is somewhat over one tube diameter in the cross-flow direction between the outer surfaces of the leading and trailing pins. Thus, holes 24 and members 26 along trailing edge 25 are similarly spaced from each other but are "staggered" relative to the holes on the leading edge. This relationship is shown in FIG. 3(*b*). Thereby, fluid may flow more easily through the support because fluid is not blocked by two retaining members in the same plane on both sides of the tube, as is the case in the prior art. Additionally, the fluid may flow between layers of tubes 12 because of the foreshortened nature of internal plates 18. Furthermore, the staggered arrangement allows tubes to be "snaked" slightly (i.e., moved from side to side) during installation, and thus, extremely strict alignment tolerances are not necessary between supports. Supports 10 are preferably placed approximately three feet apart. However, their separation should be adapted as necessary depending on the weight and vibration potential of the tubes to be supported.

FIG. 4(*a*) depicts tubes 12 installed in the square opening 28 formed by plates 16 and 18, and retaining members 26. The openings 28 are preferably square, the inner vertical dimension between the plates and the inner horizontal dimension between the retaining member being the same. FIG. 4(*b*) shows a side view of the support. As shown in the figures, a plurality of tubes 12 are held by the support 10, preferably one tube 12 to each square hole. Each tube is held in the horizontal position by only one retaining member 26 at the leading edge of the plate and only one retaining member 26 at the trailing edge of the plate. Similarly, in the embodiment shown, each tube is held in its vertical position by one elongated plate 16 and one shorter plate 18. As a result, the restriction of flow of fluid is minimized. In large heat exchange conduits, the support 10 would have two wide plates 16 and a plurality of parallel plates 18 sandwiched between the wide plates 16. Such an embodiment would further minimize flow reduction.

An example of an application of the present invention will be given to more fully describe the invention and the relative relationships of the invention. This example is explanatory only and is not restrictive of the scope of protection provided by the claims. In the example, three plates are provided. The top and the bottom plates extend 2 in. in the direction of flow, and are 9 in. wide and about $\frac{1}{8}$ in. thick. The center plate has a similar width and thickness, but only extends 1 in. in the direction of flow. Five holes of approximately 0.132 in. in diameter are provided along the leading edge of all three plates. The holes are set back $\frac{1}{4}$ in. from the edge, and the first hole begins 1 in. from the side. The holes are placed every $1\frac{3}{4}$ in. Six holes of approximately 0.132 in. in diameter are provided along the trailing edge of the top and the bottom plates. The holes are set back $\frac{1}{4}$ in. from the trailing edge, and the first hole begins $\frac{1}{8}$ in. from the side. The holes are placed every $1\frac{3}{4}$ in.

The example support is assembled by placing pins in the holes and tack welding them in place. The pins are approximately 0.129 in. in diameter and 1.75 in. in length. A support thus assembled can be used to hold $\frac{3}{4}$ in. copper tubing.

The support of the present invention avoids or at least substantially reduces flashing because of the gradual increase and decrease of the blocking cross-section. This flow characteristic of the present invention reduces the velocity and resulting pressure drop experienced by the heat exchanging fluid when passing through a support. Fluid flowing through support 10 first encounters plates 16 and 18 which increases the blocking cross-section. Next retaining members 26 proximate leading edge 22 are encountered further increasing the blocking cross-section. The flow then passes the trailing edge 25 of shortened internal plates 18 which partially reduces the blocking cross-section. Finally, the flow passes retaining members 26 proximate the trailing edge and the trailing edge itself. At this point, the blocking cross-section is completely reduced. Thus, support 10 has the advantage that the increases and decreases to the blocking cross-section do not occur in the same plane or flow cross-section.

Figure 5:
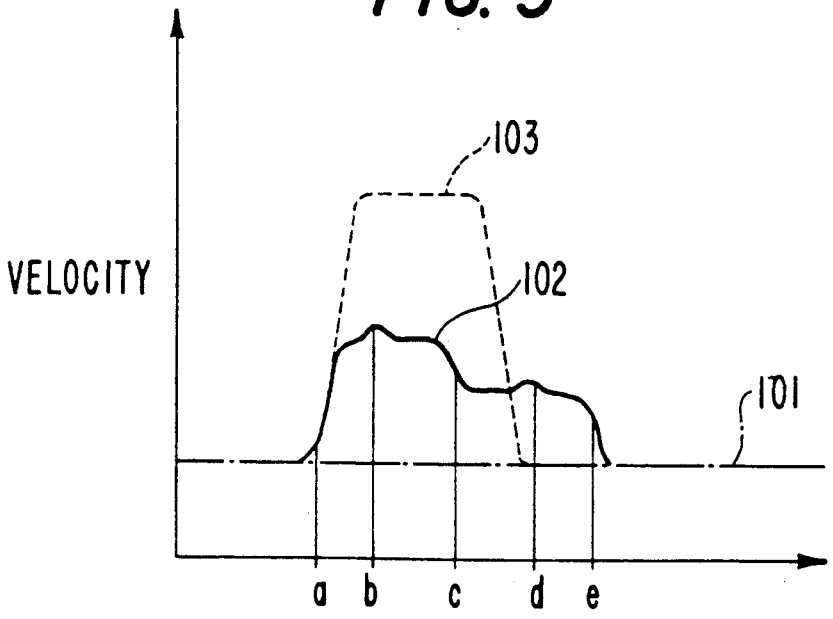
FIG. 5 figuratively depicts the velocity increase of the fluid caused by a support according to the invention.

FIG. 5 figuratively depicts an example of the velocity increase that results from fluid flow through the support of the present and around the tubes supported. Line 101 represents the fluid when it is in the conduit away from a support. Line 102 indicates velocity which occurs at the location of a support according to the invention. The fluid encounters the leading edge of all three plates at a, encounters the first set of pins at b, encounters the trailing edge of the middle plate at c, encounters the second set of pins at d, and finally encounters the trailing edge of the top and bottom plates at e. As shown, the velocity gradually increases and gradually decreases in a series of steps along the support. The support and its elements are preferably sized and positioned relative to one another, so that the overall resulting pressure is not so large as to cause flashing.

In contradistinction, line 103 represents the velocity caused by a prior art support where all of the blocking cross-section occurs at one location. As can be seen, the local velocity reaches a much higher level with the prior art support than with the invention, and therefore, the chance of flashing is much greater since pressure drop is proportional to the square of the velocity.

It will be apparent to those skilled in the art that various modifications and variations can be made to the present invention and in construction of this support without departing from the scope or spirit of the invention.

Other embodiments of the invention will be apparent to those skilled in the art from consideration of the specification and practice of the invention disclosed therein. It is intended that the specification and examples be considered as exemplary only, with a true scope and spirit of the invention being indicated by the following claims.

What is claimed is:

1. A tube support for use in a heat exchanger wherein a heat transfer medium flows outside and parallel to the tubes, the support comprising:

at least three parallel plates having plate surfaces and leading and trailing edges;

multiple plate retaining members, oriented orthogonally to the plate surfaces for retaining said plates in a spaced parallel relationship, said parallel plates and said retaining members being configured and arranged so as to provide minimal flow blockage at any one cross-section to the direction of fluid flow, said retaining members being proximate the leading and trailing edges of the plates, and the retaining members proximate the trailing edge being staggered, in a direction orthogonal to the axes of the tubes and parallel to said plates, with respect to said retaining members proximate the leading edge.

2. A support as claimed in claim 1 wherein the two outer of said plates are longer in the direction of flow than the inner of said plates.

3. A support as claimed in claim 2 wherein said retaining members proximate the leading edge are secured to each of said plates and wherein said retaining members proximate the trailing edge are only secured to the two outer of said plates.

4. A support as claimed in claim 2 wherein said outer plates are approximately twice as long in the direction of flow as the inner of said plates.

5. A support for tubes, the support for use the heat exchanger wherein a heat transfer medium flows outside and parallel to a plurality of tubes, the support comprising:

multiple parallel plates having plate surfaces and leading and trailing edges; and multiple plate retaining members, oriented orthogonally to the plate surfaces, for retaining said plates in a spaced parallel relationship, said retaining members being arranged to allow the movement of the tubes in a direction orthogonal their axes and parallel to said plates, said retaining members being proximate the leading and trailing edges of the plates, and said retaining members proximate the leading edge being spaced at least two tube diameters from each other, and said retaining members proximate the trailing edge being spaced at least two tube diameters from each other and spaced, in the direction orthogonal to the parallel to said plates, from said the leading edge.

6. A support as claimed in claim least three parallel plates, wherein the two plates are longer in the direction of flow than plates.

7. A support as claimed in claim 6, wherein retaining members proximate the leading edge are secured each of said plates and wherein said retaining members proximate the trailing edge are secured only to the two outer of said plates.

8. A support as claimed in claim 7, wherein said outer plates are approximately twice as long in the direction of flow as the inner of said plates.

* * * * *

UNITED STATES PATENT AND TRADEMARK OFFICE

CERTIFICATE OF CORRECTION

PATENT NO. : 5,050,669

DATED : September 24, 1991

INVENTOR(S) : Kurt F. Nensteil et al.

It is certified that error appears in the above-identified patent and that said Letters Patent is hereby corrected as shown below:

Claim 5, col. 6, line 26, after "the" insert --axes of the tubes and--;
line 27, before "the" insert --retaining members proximate--.

Claim 6, col. 6, line 28, after "claim" insert --5, including at--;
line 29, after "two" insert --outer of said--;
line 30, after "than" insert --inner of said--.

Claim 7, col. 6, line 31, after "wherein" insert --said--;
line 32, after "secured" insert --to--.

Signed and Sealed this

Eleventh Day of August, 1992

*Attest:*

DOUGLAS B. COMER

*Attesting Officer*

*Acting Commissioner of Patents and Trademarks*